US008756844B2

(12) United States Patent
Moretti

(10) Patent No.: US 8,756,844 B2
(45) Date of Patent: Jun. 24, 2014

(54) CLOSURE FOR BREAK-ACTION FIREARMS

(75) Inventor: Luigi Moretti, Brescia (IT)

(73) Assignee: Benelli Armi S.p.A., Urbino (IT)

( * ) Notice: Subject to any disclaimer, the term of this patent is extended or adjusted under 35 U.S.C. 154(b) by 0 days.

(21) Appl. No.: 13/534,286

(22) Filed: Jun. 27, 2012

(65) Prior Publication Data

US 2013/0167419 A1 Jul. 4, 2013

(30) Foreign Application Priority Data

Jun. 29, 2011 (IT) ..... MI2011A1185

(51) Int. Cl.
*F41A 3/58* (2006.01)

(52) U.S. Cl.
CPC ..... *F41A 3/58* (2013.01)
USPC ..... 42/44; 42/8

(58) Field of Classification Search
CPC ..... F41A 19/54; F41A 15/06; F41A 19/21; F41A 3/58; F41A 19/18; F41C 7/11
USPC ..... 42/8, 40, 41, 44, 75.01–75.04
See application file for complete search history.

(56) References Cited

U.S. PATENT DOCUMENTS

| | | | | |
|---|---|---|---|---|
| 889,279 | A * | 6/1908 | Warnant | 89/196 |
| 928,698 | A * | 7/1909 | Jaeger | 105/296 |

FOREIGN PATENT DOCUMENTS

| | | | |
|---|---|---|---|
| DE | 28 41 938 | A | 4/1980 |
| DE | 44 46 906 | C1 | 6/1996 |
| DE | 199 09 580 | A1 | 9/2000 |
| DE | 10 2007 044993 | B3 | 1/2009 |
| EP | 0862038 | A2 | 9/1998 |
| FR | 387 630 | A | 7/1908 |
| RU | 2 235 261 | C1 | 8/2004 |
| RU | 2401965 | C2 | 10/2010 |

* cited by examiner

*Primary Examiner* — Bret Hayes
*Assistant Examiner* — Joshua Freeman
(74) *Attorney, Agent, or Firm* — R. Neil Sudol; Henry D. Coleman

(57) ABSTRACT

A closure for break-action firearms which includes a barrel assembly which is hinged to a break-action assembly so as to form a closed position and an open position of the firearm; the barrel assembly has a breech end which is opposite with respect to a breech face of the break-action assembly when the firearm is in the closed position. The structure is characterized in that it includes a plate which is associated with the break-action assembly and is interposed between the breech end of the barrel assembly and the breech face of the break-action assembly in the closed position, in which the plate closes the breech end by virtue of a means for the temporary locking of the plate on the barrel assembly.

11 Claims, 6 Drawing Sheets

CLOSURE FOR BREAK-ACTION FIREARMS

BACKGROUND OF THE INVENTION

The present invention relates to a closure for break-action firearms.

Hunting and target-shooting shotguns with two superimposed barrels, called over and under shotguns, are normally provided with a so-called break-action closure, in which the barrel assembly, which has at the breech the tenons or lugs, can rotate with respect to the closure block, i.e., the break-action, about a retention pivot which is arranged transversely.

The breech end of the barrel assembly must rest against the break-action without detectable play.

During firing, the pressure generated inside the bore of the barrel in fact stresses the wall of the barrel and of the breech and the force that would tend to propel the barrel forward is substantially counterbalanced by the retention pivot and by any other surface provided in the closure system.

There are in fact various types of closure which are distinguished by the type and number of surfaces of engagement between the barrel assembly and the break-action when the firearm is closed in the firing position.

Another type of closure has a plate inserted between the barrel assembly and the break-action. The plate is coupled to the barrel assembly and has the task of absorbing the energy of the barrel toward the break-action.

RU2235261, FR387630, DE2841938, DE4446906, DE19909580 and DE102007044993 disclose break-action guns with a closure block associated with the break-action.

However, those systems must still have, like all closure systems of the known type, a very precise construction and an accurate adjustment between the breech face of the barrels and the breech face of the break-action. Moreover, even in the plate closure system of the known type, the residual energy that the barrel generates forward after firing is withstood completely by the two hinge pivots mounted on the break-action, consequently stressing the structure of the break-action.

OBJECTS OF THE INVENTION

The aim of the present invention is to provide a new type of closure that overcomes the drawbacks of the cited prior art.

Within the scope of this aim, an object of the invention is to provide a closure for break-action guns that ensures perfect closure of the breech end without requiring accurate fitting of its mechanical parts.

A further object of the invention is to provide a closure that ensures perfect operation over time without requiring accurate and frequent maintenance.

A further object is to provide a closure that frees the hinge pivots from stresses both when static and, most of all, during firing.

A further object of the present invention is to provide a closure system that allows complete interchangeability of the barrels, avoiding the fitting operations that are instead necessary in traditional systems, in which it is indispensable to intervene in order to rework the closure surfaces.

A further object of the present invention is to provide a closure for break-action firearms which, by virtue of its particular constructive characteristics, is capable of giving the greatest assurances of reliability and safety in use.

SUMMARY OF THE INVENTION

This aim and other objects which will become better apparent hereinafter are achieved by a closure for break-action firearms, comprising a barrel assembly which is hinged to a break-action assembly so as to define a closed position and an open position of the firearm; said barrel assembly has a breech end which is opposite with respect to a breech face of said break-action assembly when said firearm is in the closed position; said closure is characterized in that it comprises a plate which is associated with said break-action assembly and is interposed between said breech end of said barrel assembly and said breech face of the break-action assembly in said closed position; said plate closing said breech end by a temporary locking means that temporarily locks said plate to said barrel assembly in said closed position.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION

Figure 1:
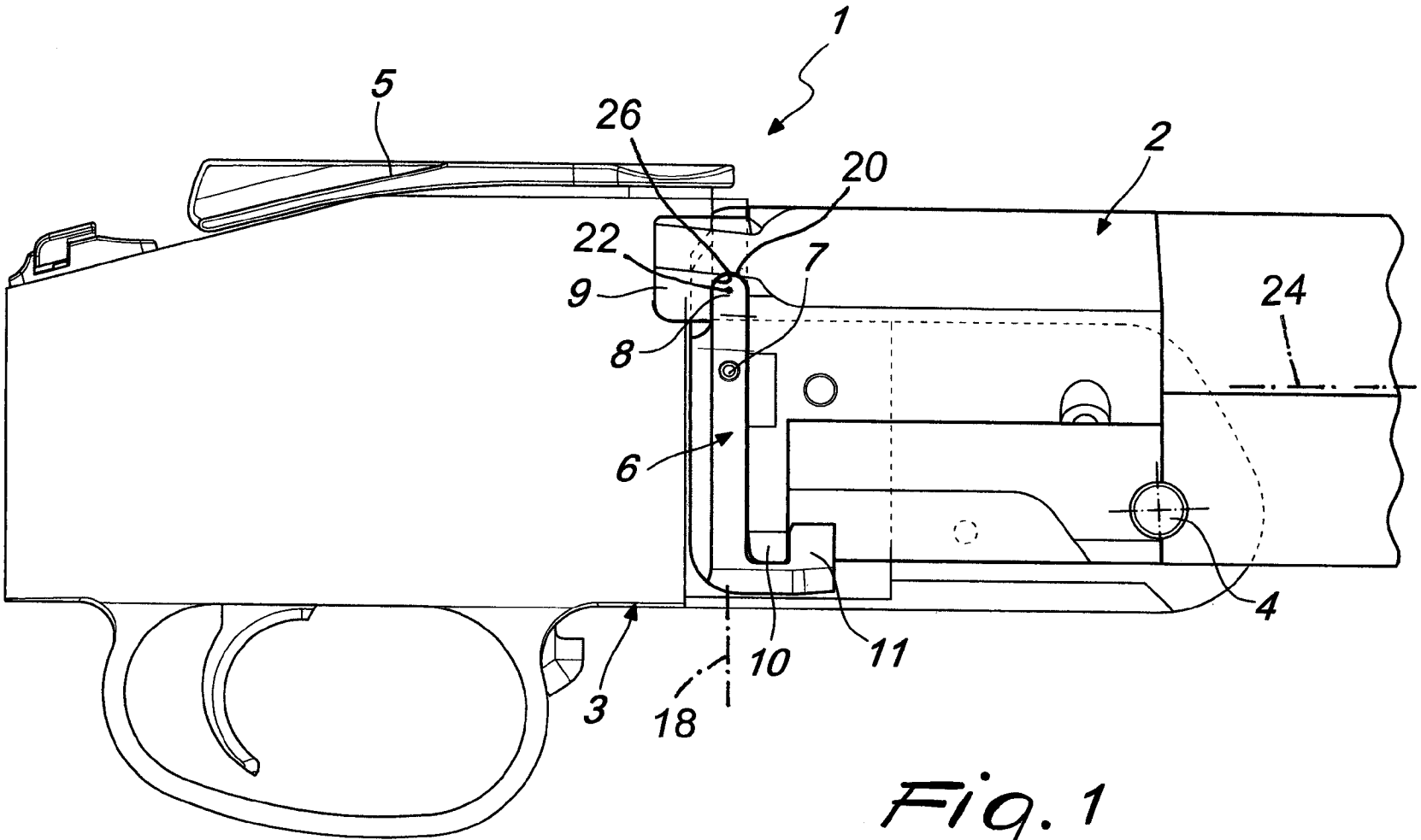
FIG. 1 is a partially sectional side view of the region of connection between the barrel assembly and the break-action, in the closed position.

With reference to the cited figures, the closure device according to the invention, generally designated by the reference numeral 1, includes a barrel assembly 2, which is pivoted to a break-action assembly 3 by means of a hinge 4, so as to define a closed position and an open position of the firearm. The opening of the firearm is actuated by means of a handle 5, in a per se known manner.

According to the present invention, a closure plate 6 is interposed between the breech face of the barrel assembly 2 and the break-action assembly 3.

The plate 6 is associated with the breech assembly 3 on a transverse axis 7 which allows an oscillation thereof in contrast with springs which push the plate forward, i.e., toward the breech end of the barrel assembly 2.

The plate 6 is monolithic, extends in a plane 18 parallel to the breech end of the barrel assembly 2 in the closed position thereof, and includes a pair of upper lateral plugs 8, which each have a rounded surface 20 that arcs about an axis 22 parallel to or in plane 18, parallel to the breech end of barrel assembly 2, and transverse to a longitudinal dimension 24 thereof in the closed position of the firearm 1. The plugs 8 are adapted to engage a pair of lugs 9 which are provided in the barrel assembly 2 at the breech end of the barrel assembly.

The barrel assembly 2 has a pair of lower lateral shoulders 10, at the breech end. The lower lateral shoulders 10 engage a hook with two lobes 11 which is provided monolithically with the plate 6.

The plate 6 has a pair of holes 12 for the passage of the firing pins of the firearm, not visible in the figures, during firing, in the closed firearm position.

Figure 2:
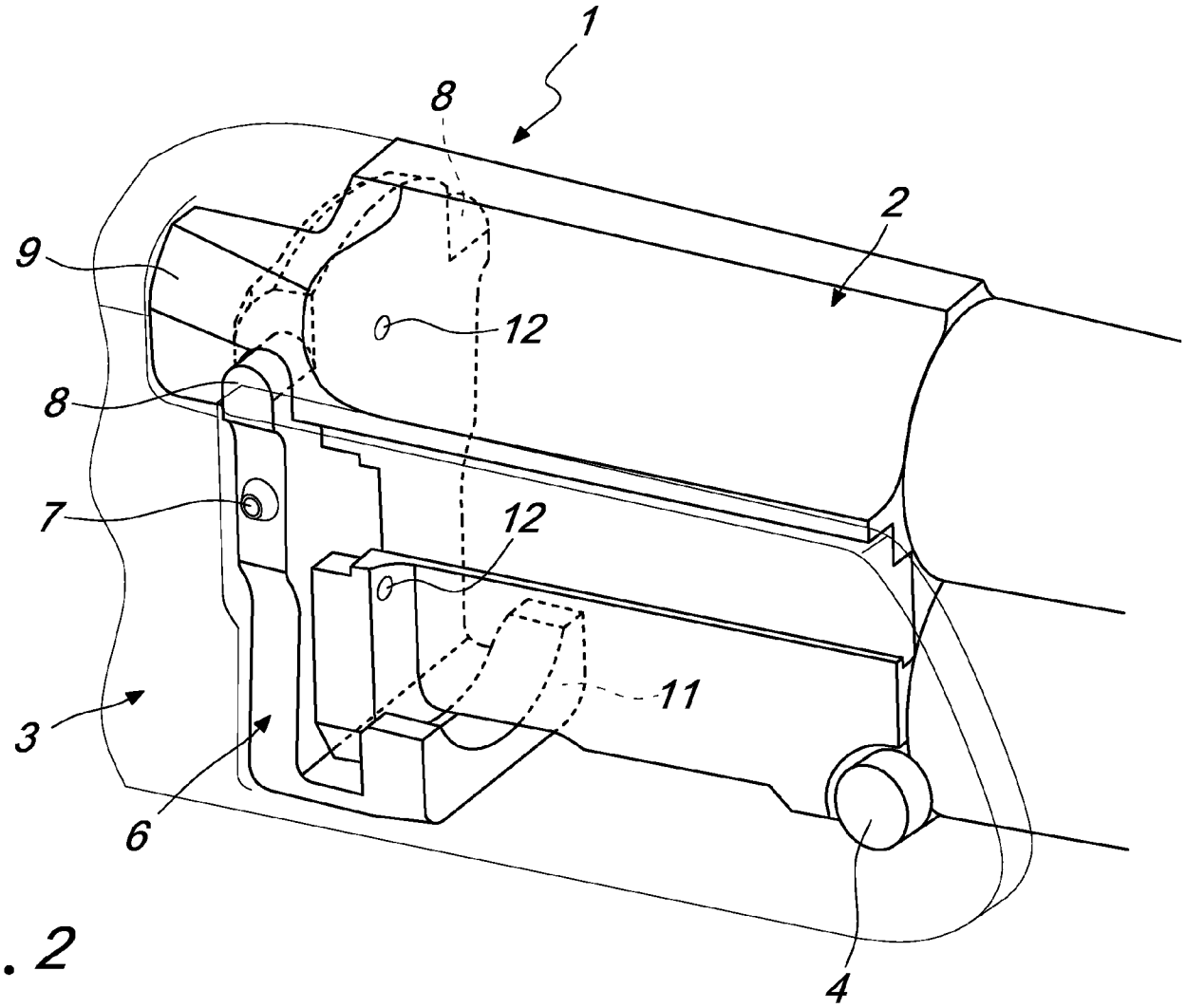
FIG. 2 is a perspective view, partially in phantom lines, of the region of connection between the barrel assembly and the break-action, in the closed position.
Figure 3:
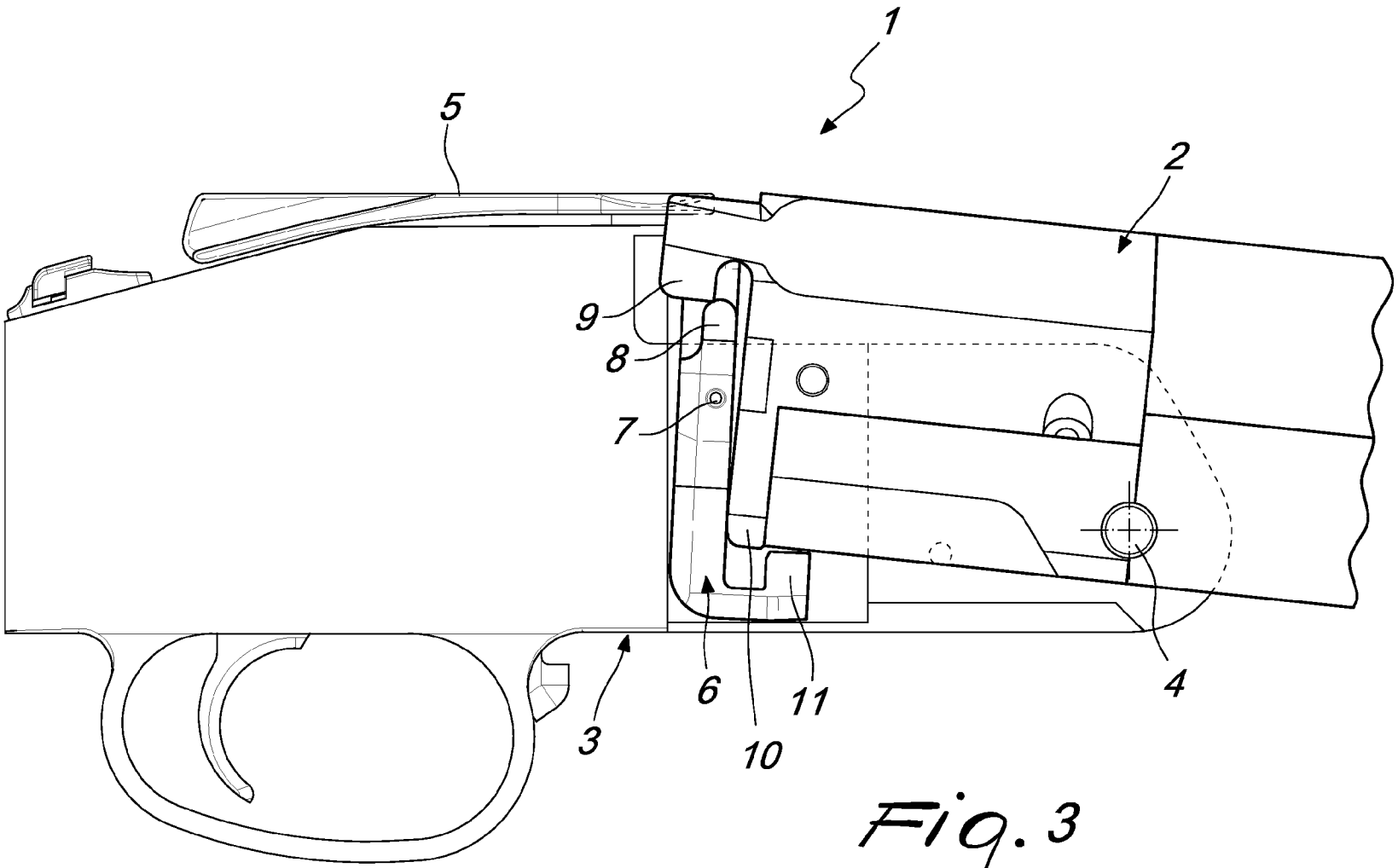
FIG. 3 is a partially sectional side view of the region of connection between the barrel assembly and the break-action, during closure.
Figure 4:
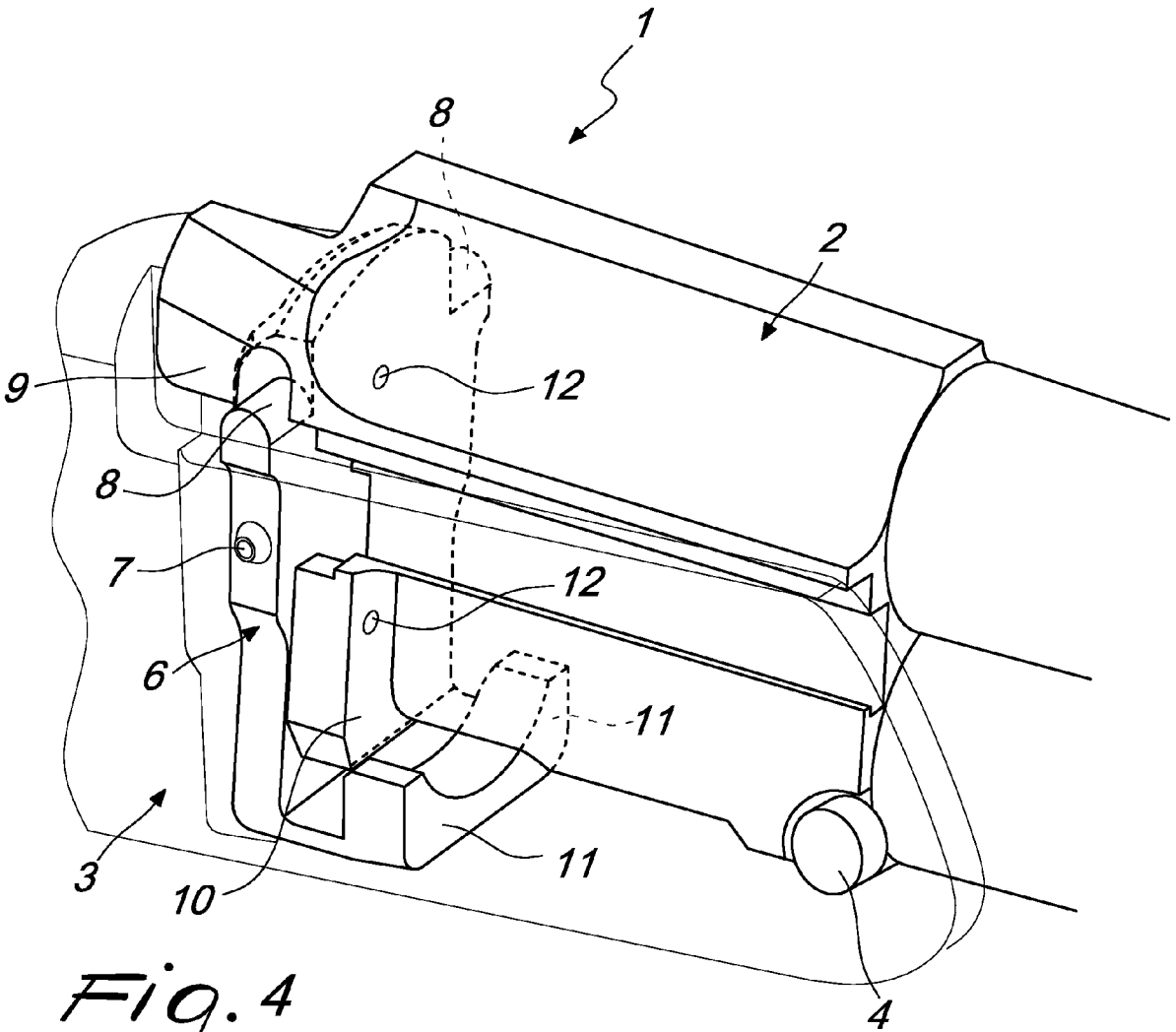
FIG. 4 is a perspective view, partially in phantom lines, of the region of connection between the barrel assembly and the break-action.
Figure 5:
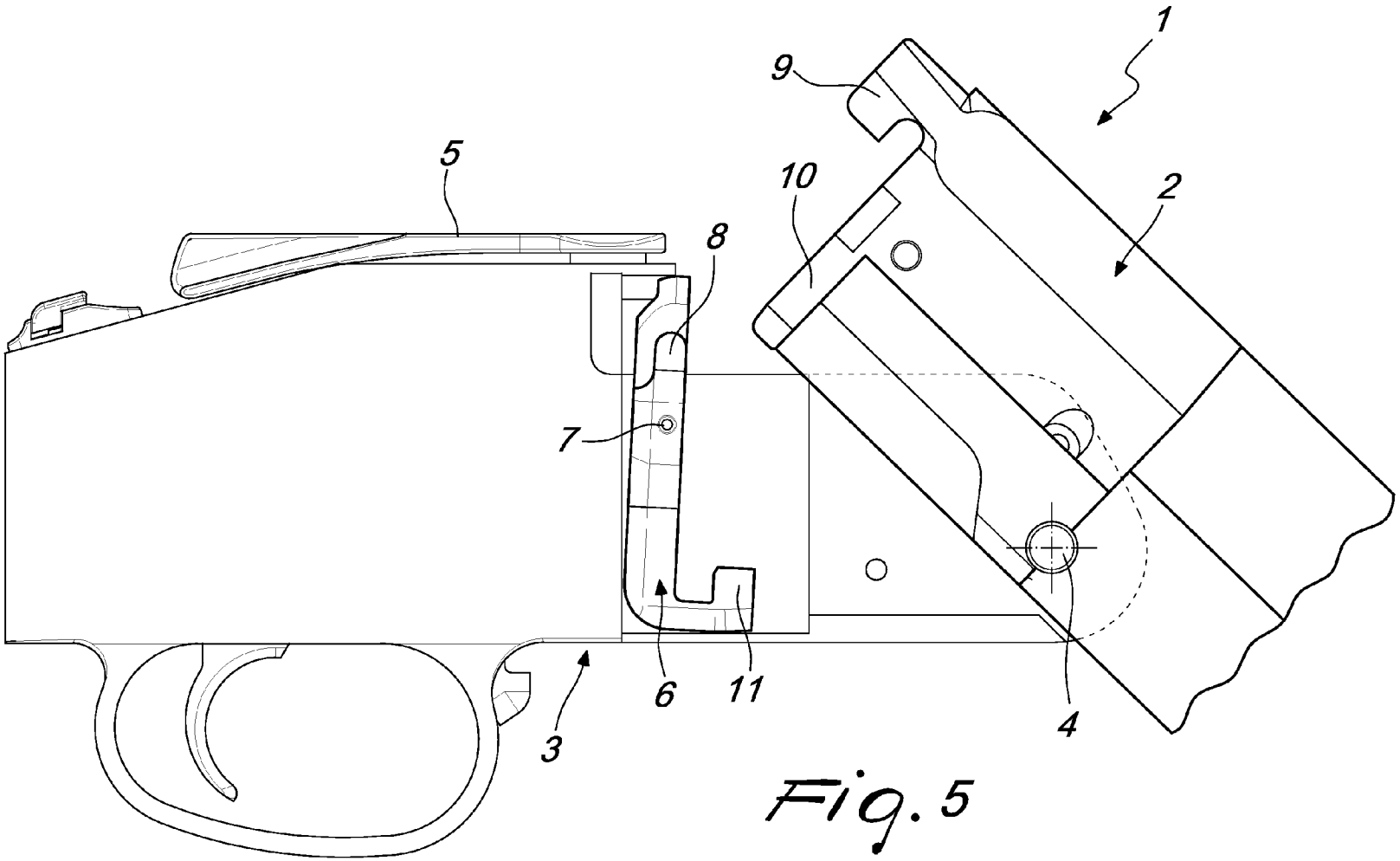
FIG. 5 is a partially sectional side view of the region of connection between the barrel assembly and the break-action, in the open position.
Figure 6:
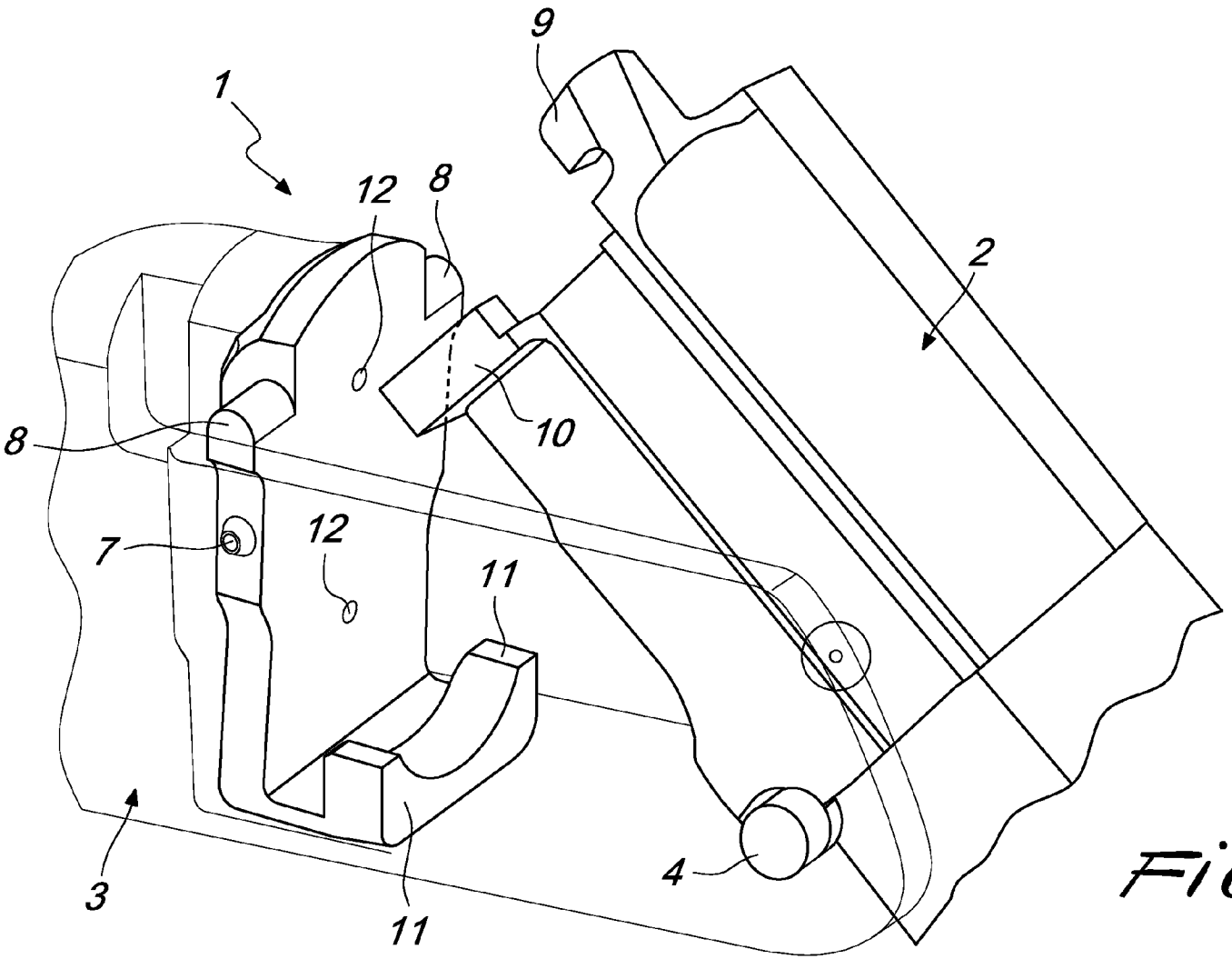
FIG. 6 is a perspective view, partially in phantom lines, of the region of connection between the barrel assembly and the break-action, in the open position.

In the closed position of the firearm, visible in FIGS. 1 and 2, the barrel assembly 2 is axially aligned with the break-action assembly 3 and the plate 6 adheres perfectly to the breech face of the barrel assembly 2.

In this closed position, the upper lateral plugs 8 of the plate 6 are inserted in the recesses 26 formed by the lugs 9 of the barrel assembly 2 and at the same time the lower lateral shoulders 10 are inserted in the recesses formed by the lobes 11 of the hook of the plate 6. Recesses 26 have rounded surfaces (not separately designated) that arc about axis 22 in the closed position of the firearm and engage the rounded surfaces 20 of respective ones of the plugs 8.

The connection thus provided ensures perfect closure of the breech face of the barrel assembly on the part of the plate and all the stresses generated by firing are discharged onto the plate, while the hinge pivots 4 of the break-action are free from any stress both when static and during firing.

After firing, the firearm is opened by operating the lever 5 and by releasing the rotation of the barrel assembly 2 about the hinge pivots 4.

The barrel assembly 2 disengages from the plate 6 by virtue of a slight rotation thereof with respect to the transverse axis 7, as shown schematically in FIGS. 3-6.

Advantageously, the device has springs or other elastic members, not visible in the figures, which keep the plate 6 inclined when the firearm is open so as to facilitate closure.

During closure of the firearm, the lugs 9 of the barrel assembly 2 engage the rounded surfaces of the upper plugs 8 of the plate while at the same time the shoulders 10 enter the hook with two lobes 11.

In practice it has been found that the invention achieves the intended aim and objects, providing a system that allows perfect closure by virtue of the recovery of the play between the barrel assembly and the plate.

The closure provided between the plate and the barrel assembly releases the hinge pivots 4, which are in no way stressed both when static and during firing.

This system therefore allows to manufacture a break-action without particular dimensional and structural solutions, which are instead indispensable in traditional constructions in order to ensure resistance to the stresses generated by the barrel during firing.

According to the present invention, the stresses generated by firing are discharged exclusively between the barrel assembly and the closure plate.

The present invention also allows total interchangeability of the barrels without particular work.

It is in fact not necessary to perform the fitting operations that are instead indispensable in traditional systems, in which it is necessary to rework the closure surfaces between the barrels and the break-action or between the barrels and the traditional closure plate.

It is evident to the person skilled in the art that the closure structure according to the present invention can be used in any type of break-action firearm and that the advantages of this invention also extend to other applications in addition to the one described here in relation to an over and under shotgun.

This application claims the priority of Italian Patent Application No. MI2011A001185, filed on Jun. 29, 2011, the subject matter of which is incorporated herein by reference.

The invention claimed is:

1. A closure for break-action firearms, comprising a barrel assembly which has a longitudinal dimension and is hinged to a break-action assembly so as to define a closed position and an open position of the firearm; said barrel assembly has a breech end that extends substantially perpendicularly to said longitudinal dimension which is opposite with respect to a breech face of said break-action assembly when said firearm is in the closed position; said closure further comprising a monolithic plate which is associated with said break-action assembly and is interposed between said breech end of said barrel assembly and said breech face of the break-action assembly in said closed position; said plate closing said breech end by a temporary locking mechanism that temporarily locks said plate to said barrel assembly in said closed position, said temporary locking mechanism including a pair of upper lateral plugs on said plate, each of which has a rounded surface that arcs about an axis parallel to said breech end and transverse to said longitudinal dimension in the closed position of the firearm and engages a respective lug provided on said barrel assembly at said breech end of said barrel assembly, said temporary locking mechanism further including on said barrel assembly, at said breech end, a pair of lower lateral shoulders that engage respective lobes of a hook provided monolithically with said plate.

2. The closure according to claim 1, wherein said plate is associated with said break-action assembly on a transverse axis which allows an oscillation thereof under the action of at least one spring which pushes said plate toward said breech end.

3. The closure according to claim 1, wherein said plate has a pair of holes for the passage of the firing pins of the firearm, during firing, in said closed position.

4. The closure according to claim 1, wherein in said closed position said barrel assembly is axially aligned with said break-action assembly and said plate adheres perfectly to said breech face of said barrel assembly; in said closed position, said upper lateral plugs of said plate are inserted in upper recesses formed by said lugs of said barrel assembly and at the same time said lower lateral shoulders are inserted in lower recesses formed by said lobes of said hook of said plate.

5. The closure according to claim 1, wherein said lugs of said barrel assembly form recesses which receive said plugs in the closed position of said barrel assembly, said recesses having rounded surfaces that arc about said axis in the closed position of the firearm and engage the rounded surfaces of respective ones of said plugs.

6. A closure for break-action firearms, comprising a barrel assembly which is hinged to a break-action assembly so as to define a closed position and an open position of the firearm; said barrel assembly has a breech end which is opposite with respect to a breech face of said break-action assembly when said firearm is in the closed position; said closure further comprising a monolithic plate which is associated with said break-action assembly, extends in a plane parallel to said breech end in said closed position of said barrel assembly, and is interposed between said breech end of said barrel assembly and said breech face of the break-action assembly in said closed position; said plate closing said breech end by a temporary locking mechanism that temporarily locks said plate to said barrel assembly in said closed position, said temporary locking mechanism including a pair of upper lateral plugs on said plate, each of which has a rounded surface that arcs about an axis parallel to or in said plane and engages a respective lug provided on said barrel assembly at said breech end of said barrel assembly.

7. The closure according to claim 6, wherein said temporary locking mechanism further includes on said barrel assembly, at said breech end, a pair of lower lateral shoulders that engage respective lobes of a hook provided monolithically with said plate.

8. The closure according to claim 6, wherein said lugs of said barrel assembly form recesses which receive said plugs in the closed position of said barrel assembly, said recesses having rounded surfaces that arc about said axis in the closed position of the firearm and engage the rounded surfaces of respective ones of said plugs.

9. The closure according to claim 6, wherein said plate is associated with said break-action assembly on a transverse axis which allows an oscillation thereof in contrast with an elastic element which pushes said plate toward said breech end.

10. The closure according to claim 6, wherein said plate has a pair of holes for the passage of the firing pins of the firearm, during firing, in said closed position.

11. The closure according to claim 6, wherein said barrel assembly comprises, at said breech end, a pair of lower lateral shoulders which are adapted to engage a hook with two lobes which is provided monolithically with said plate; wherein in said closed position said barrel assembly is axially aligned with said break-action assembly and said plate adheres perfectly to said breech face of said barrel assembly; in said closed position, said upper lateral plugs of said plate are inserted in upper recesses formed by said lugs of said barrel assembly and at the same time said lower lateral shoulders are inserted in lower recesses formed by said lobes of said hook of said plate.

* * * * *